United States Patent [19]

Ma

[11] Patent Number: 4,598,484

[45] Date of Patent: Jul. 8, 1986

[54] FOOTWEAR

[76] Inventor: Sung S. Ma, 81-11 45 Ave. 10H, Elmhurst, N.Y. 11373

[21] Appl. No.: 645,260

[22] Filed: Aug. 29, 1984

[51] Int. Cl.[4] ..... A43B 7/06

[52] U.S. Cl. ..... 36/3 R; 36/43; 128/582

[58] Field of Search ..... 36/3 R, 3 A, 3 B, 43, 36/81, 88, 44, 11.5; 128/582

[56] References Cited

U.S. PATENT DOCUMENTS

| | | | |
|---|---|---|---|
| 558,345 | 4/1896 | Bowen | 36/3 R X |
| 1,335,273 | 3/1920 | Bruce | 36/3 R |
| 3,012,342 | 12/1961 | Ramirez | 36/3 R |
| 3,426,455 | 2/1969 | Drago | 36/3 B |
| 3,722,113 | 3/1973 | Birkenstock | 36/43 X |
| 4,075,772 | 2/1978 | Sicurella | 36/43 |
| 4,095,353 | 6/1978 | Foldes | 36/43 X |
| 4,417,407 | 11/1983 | Fukuoka | 36/3 R X |
| 4,510,700 | 4/1985 | Brown | 36/44 |

FOREIGN PATENT DOCUMENTS

| | | | |
|---|---|---|---|
| 2619410 | 1/1977 | Fed. Rep. of Germany | 128/582 |

*Primary Examiner*—Werner H. Schroeder
*Assistant Examiner*—Tracy G. Graveline
*Attorney, Agent, or Firm*—Birch, Stewart, Kolasch & Birch

[57] ABSTRACT

A height-controlling insole for footwear which comprises:

an insole;

a plurality of non-slip profiles connected to the insole;

at least a portion of the profiles having an adjustable height thereof, whereby the profiles can be adjusted to conform to the curvature of the bottom of the foot.

12 Claims, 9 Drawing Figures

FOOTWEAR

BACKGROUND AND SUMMARY OF THE INVENTION

The present invention relates to footwear and more particularly, to footwear such as shoes and boots of all types having a height-controlling insole which can be adjusted by utilizing a plurality of screw elements. The present invention is also directed to non-slip profiles disposed on the insole of shoes which also contain double layer shoe uppers which permit air to be circulated through the interior thereof.

Presently known insoles for shoes comprise elastomeric pads which are made of soft materials such as sponge or rubber materials and contain a plurality of apertures in the sole, a plurality of fixed profiles, and cavities in the upper portion of the shoe.

In these types of footwear it is very difficult to press the sole of the foot or remove moisture and odor from the shoe or maintain a comfortable temperature in the footwear in the winter time.

SUMMARY AND OBJECTS OF THE INVENTION

Accordingly, it is an object of the present invention to provide footwear having non-slip profiles with controllable heights for accomodating the sole of the human foot.

Another object of the present invention is to provide footwear having a plurality of interior apertures and cavities for eliminating moisture and odor from the shoe.

It is a further object of the present invention to provide footwear having double layer uppers which are provided with a zipper on the top thereof for controlling the temperature and ventilation of the shoe.

It is still another object of the present invention to provide footwear having an expanded insole along the inside thereof for applying pressure to the inside of the sole of a foot.

Yet another object of the present invention is to provide an insole having non-slip profiles which can be used on either side of the insole of a shoe, sandal or slipper.

Numerous other objects and advantages of the present invention will become apparent from the following specification which, together with the accompanying drawings, describes and illustrates several preferred embodiments of the present invention.

Briefly described, the present invention comprises footwear having a plurality of non-slip profiles associated with the insole for controlling and varying the height of the surface which supports the foot. The shoe uppers are provided with a plurality of apertures or cavities and similarly the insole is provided with a plurality of cavities or apertures which communicate with the top edge of the shoe uppers for achieving air circulation through the interior of the shoe and throughout the shoe structure itself. This top edge of the shoe can be closed or opened by the zipper. This air circulation is achieved through the many apertures in the insole and the shoe upper and the top edge of the shoe.

Alternatively, the insole can be disposed on the top of the profiles rather than on the bottom thereof.

DETAILED DESCRIPTION OF THE INVENTION

Figure 1:
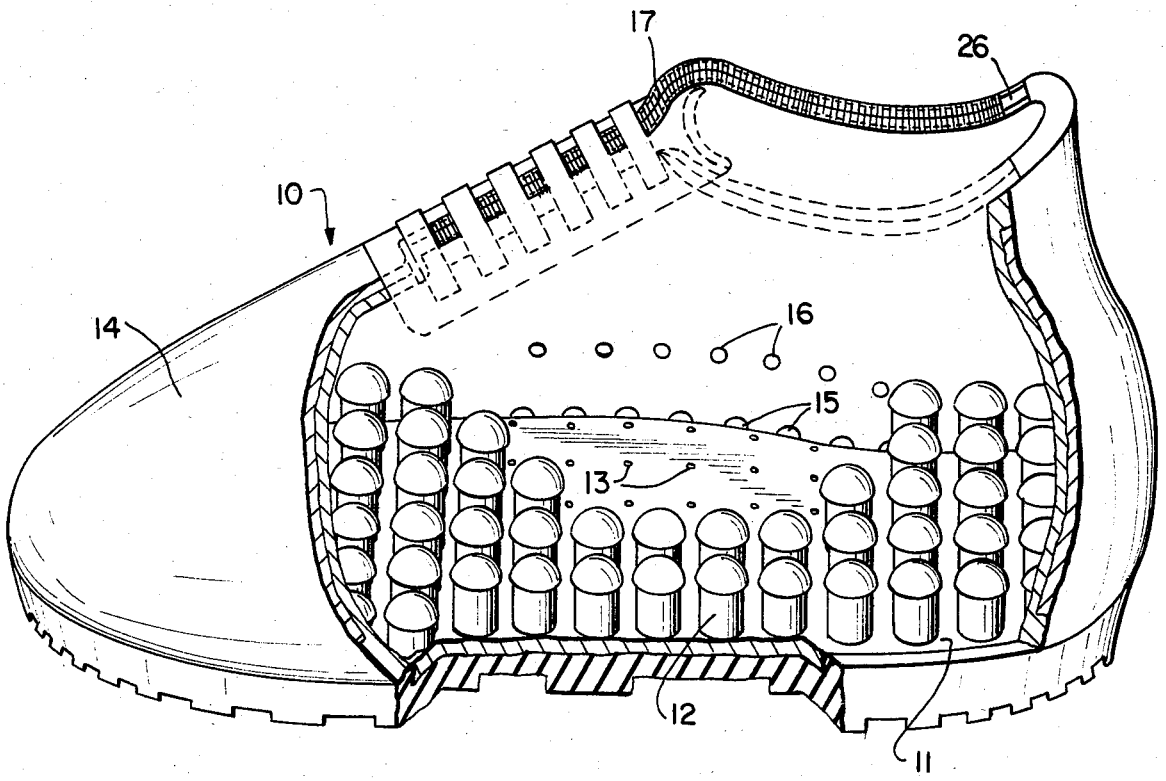
FIG. 1 is a side perspective view of the footwear of the present invention showing an insole having a plurality of nonslip profiles and numerous apertures, a double walled shoe upper having a plurality of cavities and a zipper provided at the top of the shoe uppers to open or close the double walled upper, as desired.
Figure 2:
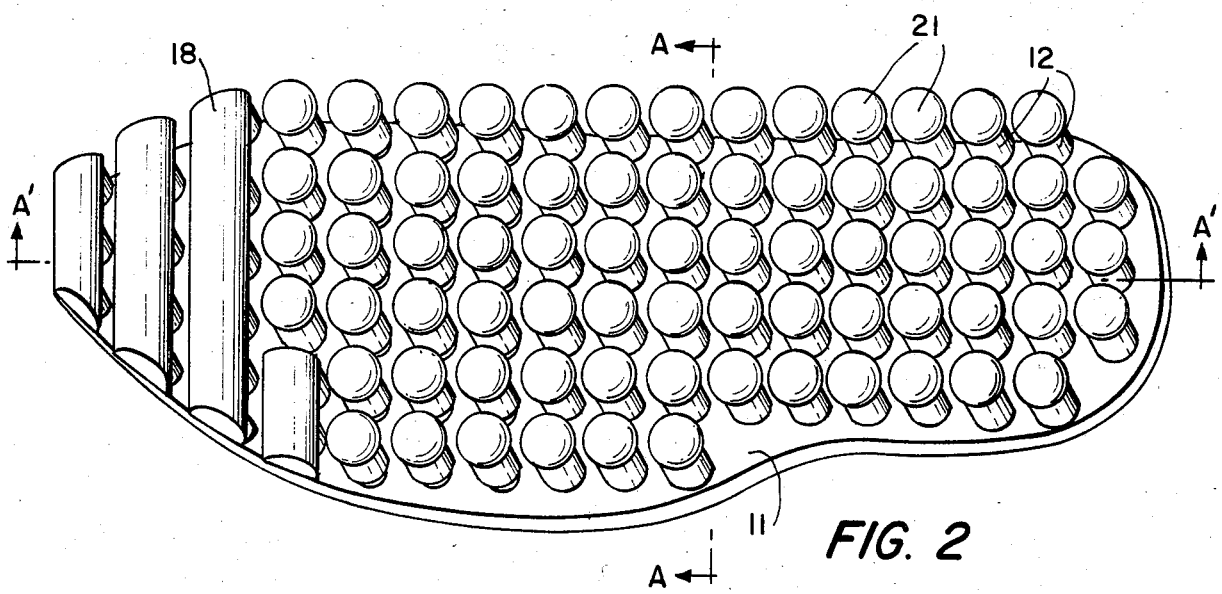
FIG. 2 is a top perspective view of the insole of the present invention provided with a plurality of profiles.
Figure 3:
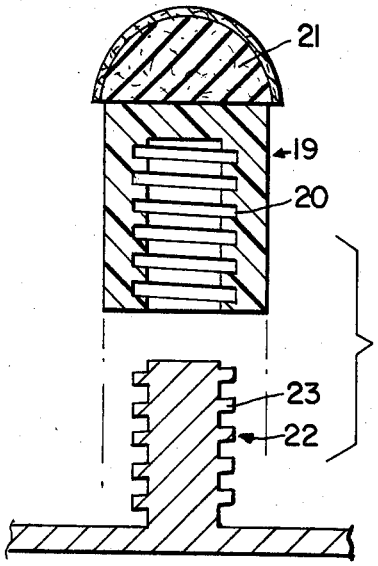
FIG. 3 is an exploded view showing the non-slip profile according to the present invention.

Referring now in detail to the drawings for the purpose of illustrating the present invention, the footwear 10 of the present invention as shown in FIG. 1 comprises an insole 11 having a plurality of non-slip profiles 12 and apertures 13, and an upper shoe portion 14 having interior bottom cavities 15, upper cavities 16 disposed midway along the shoe upper, and a zipper 17 on the top portion thereof.

The insole 11, as shown in FIGS. 2, 3, 4 and 5, can be made of any normally acceptable material such as soft plastic or rubber, and comprises a plurality of non-slip profiles 12 and a half-roll configuration 18 disposed across the top of the profiles. The half-roll configuration is constructed of about 3 and ⅓ fixed rows for receiving pressure from the toes. The non-slip profile 12 comprises a head 19 having an internal threaded portion 20 and a cap portion 21. The cap is adapted to be screwed to pins 22 provided with external threads 23. Where it is not desired to vary the height of the caps, the pins 22 are provided with a smooth surface 24 for slidably receiving heads 19 provided with a corresponding smooth surface 25. The head and cap are made of a rubber material, e.g. silicone rubber, and the cap can be further provided with a cotton material to provide a soft surface and eliminate slipping.

Figure 4:
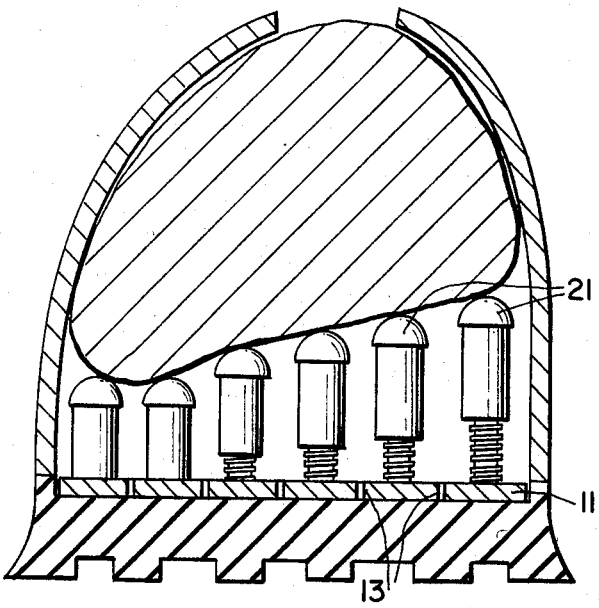
FIG. 4 is a sectional view of the insole of the present invention taken at A—A in FIG. 2.
Figure 5A:
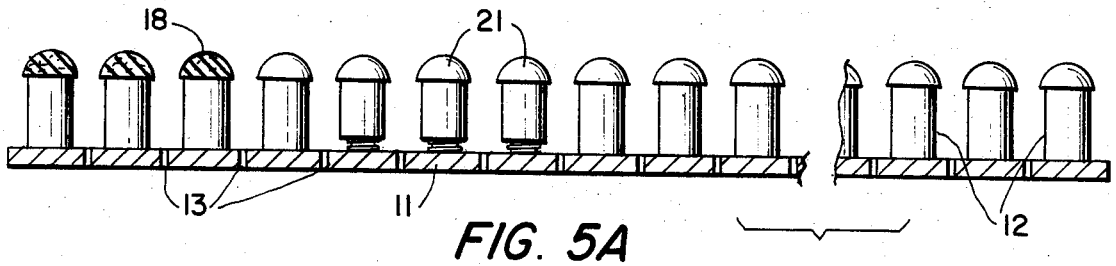
FIG. 5A is a cross-sectional view taken along the line A'—A' of FIG. 2.

Although the profiles 12 discussed above show caps with female threaded interior portions and pins with external male threads. The height of the profiles can be varied along the insole of the shoe to compensate for unevenness of the foot. However, since the profiles in the toe portion of the shoe are provided with a smooth internal surface, no height adjustment is possible. Also, the insole 11 of the present invention extends in its width into the arch area of the foot unlike prior art insoles which do not extend into the arch area. In this area the profiles have their highest position for applying pressure to the inside of the sole of the foot as shown in FIG. 4.

The upper 14 has a portion 27 for maintaining the form of the shoe, and a plurality of upper cavities 16, and a plurality of lower cavities 15 which will enable air to be circulated through the interior of the footwear with the assistance of the apertures 13 provided in the insole 11. This is important because footwear such as shoes or boots usually is provided with a layer of insulation on the inner surface thereof and a waterproof exterior surface which is air impervious.

Figure 6:
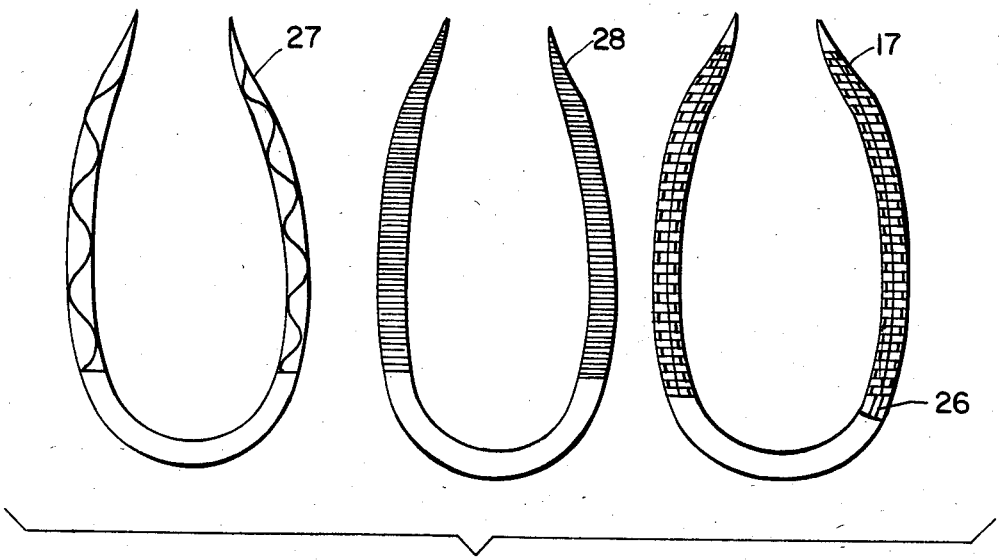
FIG. 6 shows the top of the shoe upper.
Figure 5B:
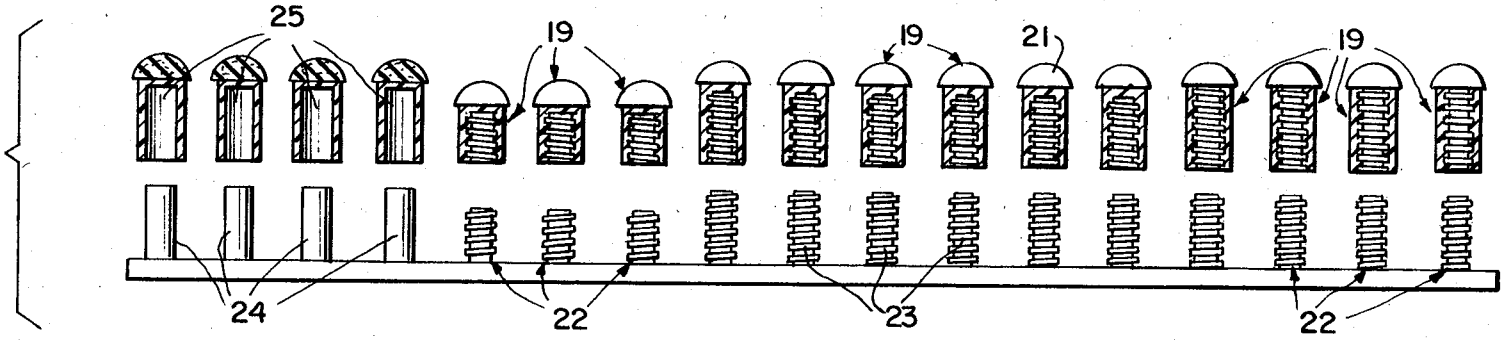
FIG. 5B is a cross-sectional view showing the non-slip profiles disposed along the insole according to the present invention.

On the upper-edge portion of the footwear upper 14, there are a wire net 28 and a zipper 17 with a zipper ring 26 in order to control the temperature condition within the shoe. For example, in Summer it is better to open the upper for cooling the wall of the shoe, but in the Winter the upper is closed to maintain a warm condition within the shoe, besides to clean the air through the wire net 28 as shown in FIG. 6.

Figure 7:
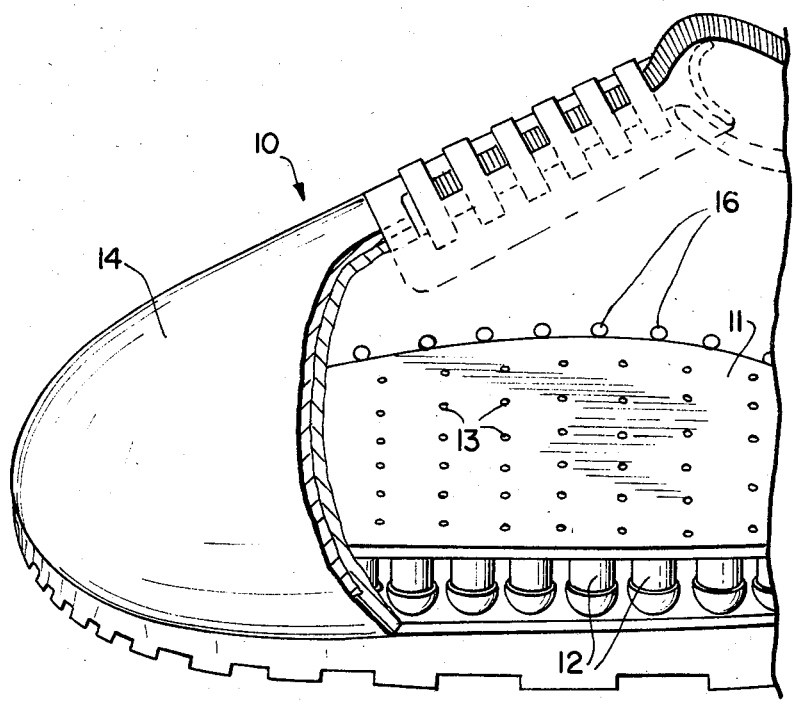
FIG. 7 is a side perspective view of the footwear of another embodiment of the present invention.
Figure 8:
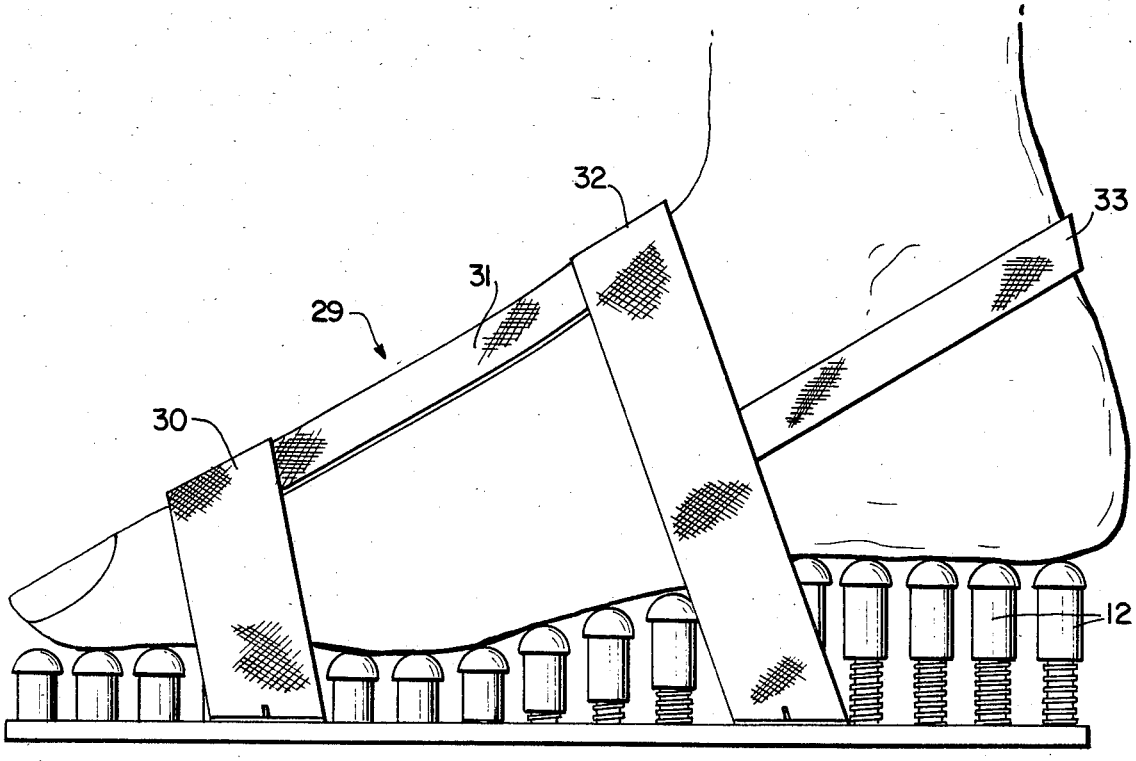
FIG. 8 is a side view of the sandal of another embodiment of the present invention.

In another embodiment of the present invention, the insole can be provided above the profiles to provide a smoother surface for the foot as shown in FIG. 7.

The shoe structure of the present invention can also be used in the form of a sandal or slipper 29 wherein the insole is provided with front straps 30, 31 and back straps 32 and 33 for indoor or summer wear.

It is contemplated that numerous changes, modifications and/or additions may be made to the specific embodiments of the present invention shown in the drawings and described above without departing from the spirit and scope of the present invention. Accordingly, it is intended that the scope of this patent be limited only by the scope of the appended claims.

I claim:

1. A height-controlling insole for footwear which comprises:

an insole;

a plurality of non-slip profile members connected to said insole; and means for varying the height of at least a portion of said profile members, said profile members including vertically disposed pins atached to the insole and a cap and head composite member which is in screw engaging relationship with said pins whereby said profiles can be adjusted to conform to the curvature of the bottom of the foot.

2. The height-controlling insole for footwear of claim 1, wherein a head of another portion of said profile members is in sliding and engaging relationship with said pins.

3. The height-controlling insole for footwear of claim 2, wherein the non-slip profiles substantially cover the surface of the insole, some of said profile members having a fixed height and some of said profile members having an adjustable height.

4. The height-controlling insole for footwear of claim 3, wherein the profiles having a fixed height are located in the toe portion of the footwear.

5. The height-controlling insole for footwear of claim 1, wherein the profiles are disposed on the upper surface of the insole.

6. The height-controlling insole for footwear of claim 1, wherein the profiles are disposed in substantially the entire surface of the insole.

7. The height-controlling insole for footwear of claim 1, wherein holes are provided in the insoles between adjacent profiles.

8. The height-controlling insole for footwear of claim 1, wherein the insole is provided with foot retaining straps.

9. The height-controlling insole for footwear of claim 1, wherein the insole is provided with a footwear upper having a plurality of layers, the inner layer thereof containing a plurality of ventilated holes.

10. The height-controlling insole for footwear of claim 9, wherein the layers of the footwear upper are provided with internal partition means.

11. The height-controlling insole for footwear of claim 10, wherein the upper-edge portion of the footwear upper contains a wire net.

12. The height-controlling insole for footwear of claim 11, wherein the upper-edge portion of the footwear is further provided with a zipper.

* * * * *